United States Patent [19]

Hamers

[11] Patent Number: 4,575,386

[45] Date of Patent: Mar. 11, 1986

[54] METHOD OF LIQUEFYING A GAS AND LIQUEFIER FOR CARRYING OUT THE METHOD

[75] Inventor: Leo J. M. Hamers, Eindhoven, Netherlands

[73] Assignee: U.S. Philips Corporation, New York, N.Y.

[21] Appl. No.: 651,485

[22] Filed: Sep. 17, 1984

[30] Foreign Application Priority Data

Mar. 29, 1984 [NL] Netherlands ..... 8400990

[51] Int. Cl.[4] ..... F25J 3/00

[52] U.S. Cl. ..... 62/11; 62/54; 62/514 R

[58] Field of Search ..... 62/514 R, 54, 11, 9

[56] References Cited

U.S. PATENT DOCUMENTS

| | | | |
|---|---|---|---|
| 3,667,246 | 6/1972 | St. Lorant et al. | 62/514 R |
| 4,242,885 | 6/1981 | Quack et al. | 62/514 R |
| 4,277,949 | 7/1981 | Longsworth | 62/514 R |
| 4,432,216 | 2/1984 | Matsuda et al. | 62/514 R |

OTHER PUBLICATIONS

Feibush, A. M. et al.: "Nitrogen for LNG/LPG Ships by Pressure Swing Adsoption", Gastech Conference Houston, Texas, Nov. 1979.

*Primary Examiner*—Ronald C. Capossela
*Attorney, Agent, or Firm*—Rolf E. Schneider

[57] ABSTRACT

A method of liquefying a gas comprises precooling such gas at a first, superatmospheric pressure in a first heat exchanger; and introducing the precooled gas into a cryogenerator to effect condensation thereof. The resulting saturated liquid-wet vapor mixture is passed to a liquid separator and then to a second heat exchanger maintained in a bath of such liquid contained in a thermally isolated reservoir to effect sub-cooling of the saturated liquid and condensation of the wet vapor and sub-cooling of the resulting condensate at a second pressure, such sub-cooling and such condensation resulting in evaporation of a portion of the liquid bath in the reservoir. The sub-cooling is regulated by adjusting the second pressure between a maximum corresponding to the first, superatmospheric pressure and a minimum corresponding to the pressure in the reservoir. The vapor resulting from such evaporation is passed to the first heat exchanger to effect the precooling. Liquid is added from the condensate stream after the liquid separator to the liquid bath to replenish the evaporated liquid.

6 Claims, 5 Drawing Figures

METHOD OF LIQUEFYING A GAS AND LIQUEFIER FOR CARRYING OUT THE METHOD

Figure 1:
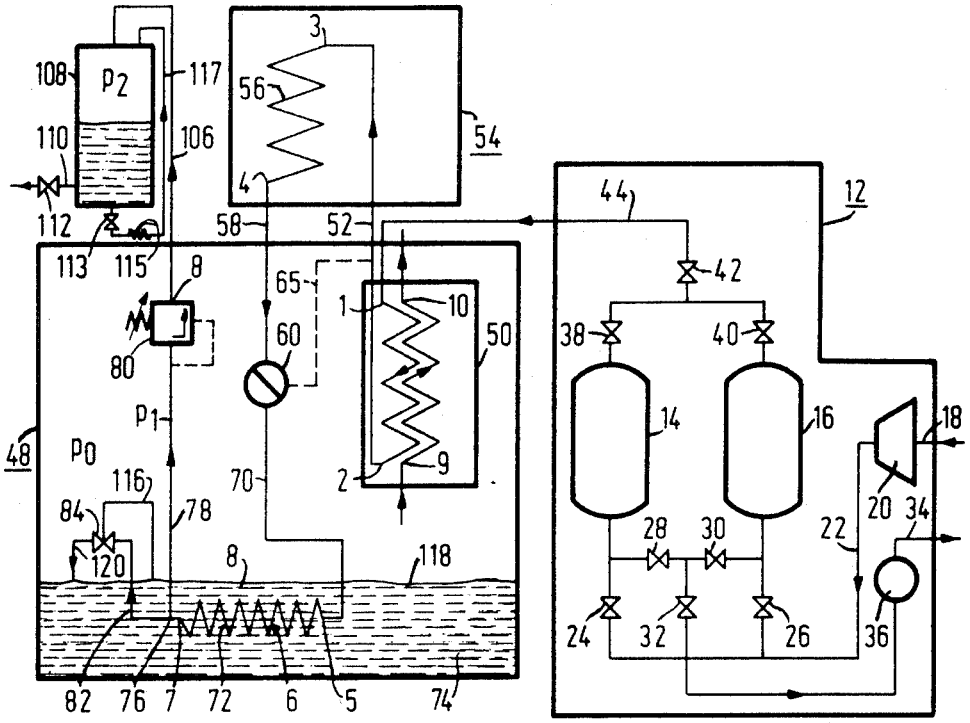

This invention relates to a method of liquefying a gas at a superatmospheric first pressure supplied by a gas-supplying device in that this gas is supplied to a cryogenerator and the liquid formed is then brought to a second pressure, which is equal to or lower than the first pressure.

The invention further relates to a liquefier for carrying out the said method.

In a known method of the kind mentioned above (from a publication of Dr. A. M. Feibush et al., presented at the GASTECH Conference held in Houston in November, 1979 and entitled "Nitrogen for LNG/LPG ships by Pressure Swing Adsorption"), condensed nitrogen gas from the cryogenerator is collected in the liquid state in a storage vessel. The nitrogen evaporating in this storage vessel by cold leakage is fed back to the cryogenerator and is condensed again in order to maintain the level of the liquid nitrogen in the storage vessel. When the gas-separation device fails, the liquid nitrogen is fed from the storage vessel to an evaporator and is thence supplied in the gaseous state to a user. As a matter of course, liquid nitrogen may also be directly extracted from the storage vessel although the known device is not designed for this purpose in the first instance.

A disadvantage of the known method is that, after liquid nitrogen has been extracted from the storage vessel, cold leakage and/or pressure drop along the path between the storage vessel and the user leads to the formation of nitrogen gas, which has little value for the user if he wants liquid nitrogen. The nitrogen gas formed moreover represents a quantity of cold which is not utilized. Furthermore, the location of the cryogenerator is limited to the top of the storage vessel in order to prevent the cryogenerator from being filled with returning liquid already condensed.

The present invention has for its object to provide a method of the kind mentioned above, in which the said disadvantages are avoided.

The invention also has for its object to provide a liquefier for carrying out the method according to the invention.

The invention is characterized in that the gas flowing out of the gas-supplying device is cooled in a first gas/-gas heat exchanger before it is supplied to the cryogenerator, after which the saturated liquid formed in the cryogenerator by condensation and wet vapour are conducted to a liquid separator, while the saturated liquid emanating from the liquid separator and the wet vapour formed after the liquid separator by expansion are conducted to a second heat exchanger which is situated in liquid already produced in a thermally isolated reservoir and are condensed and sub-cooled, respectively, in this second heat exchanger, the degree of sub-cooling being obtained by means of a pressure controller connected to the second heat exchanger, after which regulation of said sub-cooling is effected by means of the adjustment of the said second pressure between a value corresponding to a maximum value of the second pressure equal to the pressure in the cryogenerator and a value corresponding to a minimum value of the second pressure equal to the pressure in the reservoir, while the condensation heat and the sub-cooling heat are utilized for evaporating a part of the liquid present in the thermally isolated reservoir and the vapour formed thereby is conducted to the first heat exchanger for cooling the gas supplied by the gas-supplying device, the liquid evaporated in the reservoir being replenished by means of a supply lead connected after the liquid separator.

The invention is further characterized in that an outlet of the gas-supplying device is connected to a thermally isolated first heat exchanger, which is situated together with the second heat exchanger and the liquid separator in the thermally isolated reservoir and is connected to the cryogenerator, while a liquid lead from the cryogenerator arranged outside the thermally isolated reservoir is connected to the liquid separator, which has an outlet lead which is connected to the second heat exchanger and which is connected via the pressure controller to a user, the opening pressure of the pressure controller being independent of the user pressure, while the reservoir is provided with a level controller which is connected to the outlet lead of the liquid separator.

It should be noted that it is known per se (from U.S. Pat. No. 4,296,610) to transport more or less strongly sub-cooled cryogenic liquid from a supplying device to a user in order to avoid evaporation due to cold leakage and/or pressure drop. The condensation heat and the sub-cooling heat released during condensation and sub-cooling are lost, however, and even lead to a temperature increase and a pressure increase of the cooling liquid, which have to be eliminated again.

Figure 3:
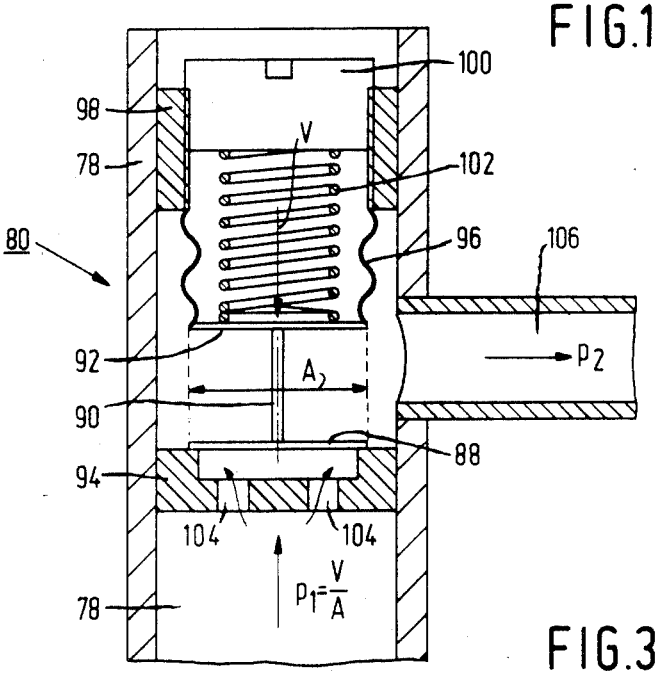
Figure 2:
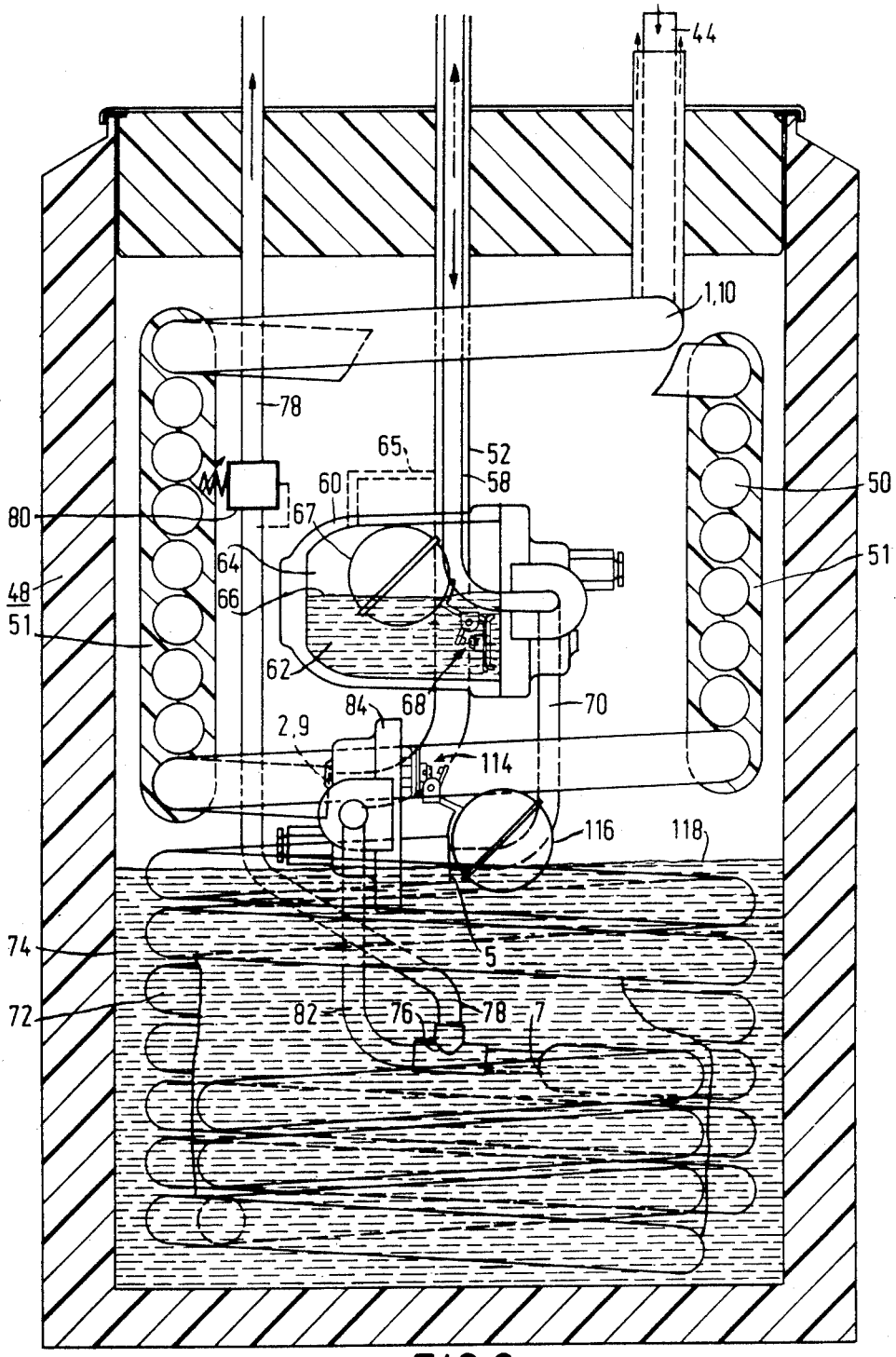
Figure 4:
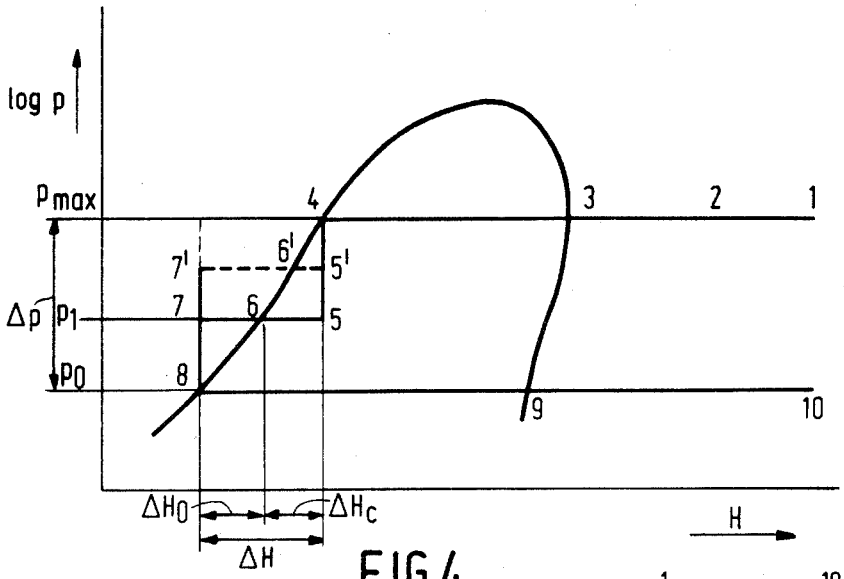
Figure 5:
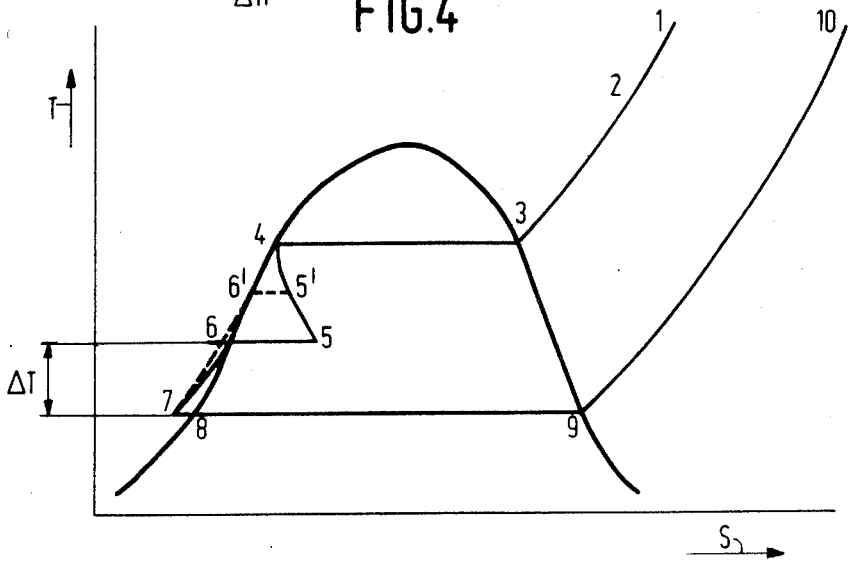

The invention will now be described more fully with reference to the accompanying drawing, in which:

FIG. 1 shows diagrammatically a liquefier,

FIG. 2 shows in detail on an enlarged scale the thermally isolated reservoir of the equipment shown in FIG. 1, FIG. 3 shows on a still larger scale a diagrammatic detail of the pressure controller shown in FIG. 2, FIG. 4 shows a pressure-enthalpy diagram which corresponds to the method according to the invention, FIG. 5 shows a temperature-entropy diagram corresponding to the method according to the invention.

The liquefier shown in FIG. 1 includes a gas-supplying device in the form of a gas-separation device 12 comprising two molecular sieves 14 and 16. The gas-separation device 12 is of a kind known per se, as described, for example in the magazine "Fuel" of September, 1981 (Vol. 60) on pages 817–822. Air is drawn in via an inlet lead 18 by a compressor 20, which discharges air at, for example, 650 kP (kiloPascal) into an outlet lead 22 which is connected by means of cocks 24 and 26 to the molecular sieves 14 and 16, respectively. The molecular sieves 14 and 16 are further connected by means of cocks 28, 30 and 32 to an outlet lead 34, in which a vacuum pump 36 may be arranged. The vacuum pump 36 may be dispensed with if use is made of the compressor 20. The molecular sieves 14 and 16 separate the nitrogen gas from the oxygen gas, the oxygen rich air being left in the sieves and the nitrogen gas being passed via cocks 38, 40 and 42 into a supply lead 44. When the cocks 24, 26, 28, 30, 32, 38, 40 and 42 are alternately opened and closed, always one of the sieves 14 and 16 is used for passing nitrogen gas into the supply lead 44, while the other sieve is cleaned by blowing the absorbed oxygen gas to the atmosphere. A flow of nitrogen gas at an average pressure of 650 kP can thus be obtained in the supply lead 44. Via the supply lead 44 the nitrogen gas is passed into a thermally isolated reservoir 48, i.e. into a gas/gas heat exchanger 50 arranged in this reservoir. The nitrogen gas enters the heat exchanger 50 at the area of the reference numeral 1 and leaves the heat exchanger 50 at the reference numeral 2. It should be noted that the reference numerals 1–10 are used to explain the thermodynamic procedure of the method, also with reference to the diagrams in FIGS. 4 and 5, which are provided with corresponding reference numerals 1–10. The temperature of the nitrogen gas at the area of the reference numeral 1 is 288° K. In the heat exchanger 50, the nitrogen gas at 288° K. is precooled to 243° K. by means of cold nitrogen gas at 78° K. which enters the heat exchanger 50 at the reference numeral 9 and leaves this heat exchanger at the reference numeral 10. The cold nitrogen gas is then heated to 288° K. For the cold transfer in the heat exchanger 50 use may be made of two concentric pipes with the nitrogen gas at the comparatively high temperature in the inner pipe and the nitrogen gas at the comparatively low temperature between the outer pipe and the inner pipe. The heat exchanger 50 is thermally isolated from the reservoir 48 by isolating material 51, such as, for example, polyurethane foam. It will be described more fully hereinafter how the cold nitrogen gas for the heat exchanger 50 is obtained.

The precooled nitrogen gas leaves the heat exchanger 50 at a temperature of 243° K. and is conducted via a lead 52 to a cryogenerator 54. The cryogenerator 54 is of a kind known per se, as described, for example, by J. W. L. Köhler and C. O. Jonkers in "Phillips Technical Review", Volume 6, October 1954, pages 105–115. The cryogenerator accommodates a heat exchanger 56 wherein the nitrogen gas entering at reference numeral 3 at a temperature of 243° K. and a pressure of 650 kP is condensed. The liquid nitrogen leaves heat exchanger 56 at the reference numeral 4 at a temperature of 96° K. and a pressure of 650 kP. The cryogenerator 54 is connected by means of a lead 58 to a liquid separator in the form of a liquid trap 60 arranged in the thermally isolated reservoir 48 (see also FIG. 2). The liquid nitrogen 62 is collected in the lower part of the liquid trap 60. Above the liquid nitrogen there is present gaseous nitrogen 64 which originates from the cryogenerator 54 and which is blown during the starting state of the equipment via a pressure equalizing lead 65 (dotted) to the lead 52 in order to prevent the liquid nitrogen in the lead 58 from being driven back to the cryogenerator 54. As soon as the level 66 of the liquid nitrogen has reached a given height, a valve 68 is opened by means of a float 67 and the liquid nitrogen is passed into a lead 70, which connects the liquid trap 60 to a liquid/liquid/gas heat exchanger 72 (second heat exchanger) arranged in the reservoir 48. The heat exchanger 72 is situated in liquid nitrogen 74 at 78° K. which is formed during the starting stage of the liquefying process. In the heat exchanger 72, the liquid nitrogen entering the heat exchanger at reference numeral 5 at a temperature of 91° K. is cooled and sub-cooled, respectively, to a temperature of 78° K. at the reference numeral 7. Furthermore, the nitrogen gas formed by the pressure drop across the liquid trap 60 is condensed again along the path which is indicated by reference numerals 5–6 and is then sub-cooled along the path which is indicated by reference numerals 6–7. After the heat exchanger 72 there is arranged a branch 76. A lead 78 connects the heat exchanger 72 to a pressure controller 80 and a supply lead 82 connects the heat exchanger 72 to a level controller 84, which will be described further.

The pressure controller 80 shown in FIG. 3, which is indicated only schematically in FIG. 2 for the sake of clarity, is arranged in the reservoir 48. The pressure controller 80 has a plunger which is composed of a valve 88 which is secured by means of a transverse rod 90 to a plate-shaped support 92. The surface of the valve 88 and that of the plate-shaped support 92 along which the liquid nitrogen flows are preferably equal. Below the opening pressure, the valve 88 engages a valve seat 94 which is secured in the lead 78. A comparatively slack bellows 96 is secured to the support 92. The bellows 96 is secured at its end remote from the support 92 to a sleeve 98 secured to the lead 78. The sleeve 98 is provided with a screw-thread for adjusting a regulating screw 100. There is arranged between the regulating screw 100 and the support 92 a helical spring 102 which is rigid with respect to the bellows 96. When the valve 88 is opened, the lead 78 is in open communication with a lead 106 by means of passage openings 104. The lead 106 is connected to a storage container 108 having an outlet lead 110 in which a cock 112 for the user is present. It should be noted that, if the pre-stress of the spring 102 is equal to V and the surface of the support 92 and that of the valve 88 are each equal to A, the opening pressure $p_1$ is equal to V/A. This means that the opening pressure $p_1$ is independent of the user pressure $p_2$ (second pressure) in the lead 106 and the storage container 108. Consequently, by regulating the prestress V, the pressure drop across the liquid trap 60 can be adjusted.

The level controller 84 has a valve 114 (see FIG. 2) which can be opened or closed by means of a float 116 which follows the height of the liquid nitrogen level 118 in the reservoir 48. When the valve 114 is opened, liquid nitrogen is added to the liquid nitrogen 74 in the reservoir 48 via a lead 120. At the starting stage of the liquefying equipment, the cryogenerator 54 will supply liquid nitrogen to the reservoir 48 until the level 118 reaches a height at which the valve 114 is closed. Since the liquid nitrogen and the gaseous nitrogen in the heat exchanger 72 constantly give off heat to the liquid nitrogen 74, a part thereof will continuously evaporate. This evaporated nitrogen of at 78° K. is supplied at the reference numeral 9 to the gas/gas heat exchanger 50 for precooling the nitrogen gas supplied by the gas-separation device 12. The liquid nitrogen in the reservoir 48 evaporated by the heat exchanger 72 is constantly replenished by means of the level controller 84. It should be noted that the level controller 84 may also be connected to the lead 70 after the liquid trap 60.

The method and its possibilities will be explained more fully with reference to the diagrams in FIGS. 4 and 5. If in the method as indicated by the successive reference numerals 1–10 in FIGS. 4 and 5 the pre-stress is increased, the opening pressure $p_1$ will increase, for example, to the level which is indicated by the reference numerals 5', 6' and 7'. The degree of sub-cooling now increases by an amount which is given by the difference in length between the path 6-7 and the path 6'-7'. The ratio between the sub-cooling enthalpy $\Delta H_o$ and the condensation enthalpy $\Delta H_c$ has then changed, whilst the sum of sub-cooling enthalpy and condensation enthalpy $\Delta H = \Delta H_o + \Delta H_c$ remains constant. The total amount of heat given off by the liquid nitrogen and the gaseous nitrogen in the heat exchanger 72 to the liquid nitrogen 74 in the reservoir 48 (indicated by the path 8-9) has consequently remained equal, just like the cooling capacity of the heat exchanger 50. The user pressure $p_2$ may lie between $p_o$ and $p_{max}$ and may consequently vary by an amount $\Delta p$. According as the service pressure $p_2$ therefore is higher or lower, the degree of sub-cooling of the extracted liquid nitrogen is also greater or smaller.

It should be noted that in the case in which the second or user pressure $p_2$ is lower than the opening pressure $p_1$ and is larger than or equal to the pressure $p_o$ in the reservoir ($p_o \leqq p_2 \leqq p_1$), the sub-cooling obtained by the user is smaller than the sub-cooling $\Delta H_o$ obtained by means of the heat exchanger 72. The pressure between the liquid trap 60 and the pressure controller 80 in this case is invariably $p_1$ because the pressure controller 80 is closed at a pressure higher than $p_1$. In the case in which the user pressure $p_2$ is lower than or equal to $p_{max}$ and is greater than the opening pressure $p_1$ ($p_1 < p_2 \leqq p_{max}$), the sub-cooling obtained by the user is greater than the sub-cooling $\Delta H_o$ obtained by means of the second heat exchanger 72. The pressure between the liquid trap 60 and the pressure controller 80 is now $p_2$. In the case in which the user pressure $p_2$ is equal to the opening pressure $p_1$, the sub-cooling obtained by the user is equal to the sub-cooling $\Delta H_o$ obtained by the heat exchanger 72. The pressure between the liquid trap 60 and the pressure controller 80 is now $p_1 = p_2$. Thus, it is achieved that the user can vary the degree of sub-cooling and the user pressure according to desire. By means of the cock 112, the user can take off liquid nitrogen. The user pressure $p_2$ can be adjusted by means of a reducing cock 113 and an evaporator 115; the resulting gaseous nitrogen is fed back via a lead 117 to the storage container 108 and is subjected to the ambient temperature. This is of major importance because the always occurring loss of pressure on the side of the user now need no longer lead to the formation of nitrogen gas. The degree of sub-cooling for the user adaptable to this loss of pressure is in fact determined by the pressure difference between the user pressure $p_2$ and the pressure $p_o$ in the reservoir 48 (see FIG. 4). If for the user sub-cooled liquid nitrogen is required, the user pressure $p_2$ consequently lies above the pressure $p_o$ in the reservoir 48 so that the pressure $p_o$ (reference numeral 8) is not reached. Frequently, the pressure $p_o$ in the reservoir 48 will be equal to atmospheric pressure. Since by means of the pressure controller 80 the pressure drop across the liquid trap 60 and hence the level of the path 5-7 in FIG. 4 is determined, the adjustment of the pressure controller consequently also determines (see FIG. 5) the available temperature difference $\Delta T$ along the path 5-7 for the heat exchange in the heat exchanger 72.

In the embodiment of the reservoir 48 shown in FIG. 2, the heat exchanger 50 is composed of two concentric pipes (not visible). The nitrogen gas from the gas-separation device 12 enters via the lead 44 the heat exchanger 50 at reference numeral 1 and leaves this heat exchanger again at reference numeral 2 via the lead 52 (in FIG. 2 located behind the lead 58), which is connected to the cryogenerator 54. The cold nitrogen gas evaporated in the reservoir 48 enters the heat exchanger 50 at reference numeral 9 and leaves this heat exchanger at reference numeral 10. The heat exchange takes place according to the counterflow principle. Since the nitrogen gas heated in the heat exchanger 50 is conducted out of the reservoir 48 to the ambient air, atmospheric pressure (98 kP) prevails in the reservoir 48. When a pressure controller is included in the lead to the ambient air, a pressure exceeding atmospheric pressure can be obtained in the reservoir 48. In the pressure-enthalpy diagram of FIG. 4, the path 8-9-10 is then located at a higher pressure level. Thus, not only the ratio between the condensation enthalpy and the sub-cooling enthalpy along the path 5-6-7 (at constant condensation enthalpy), but also the sum of the two enthalpies and hence the quantity of evaporated nitrogen from the reservoir 48 available for precooling are changed. The degree of precooling can thus be regulated.

Although the liquefying equipment has been described with reference to nitrogen, other substances, such as oxygen, hydrogen, methane, argon etc., may also be used. For this purpose, it is only required to utilize a gas-separation device 12 and a cryogenerator 54 adapted to these substances. It should be noted that the gas-supplying device is not limited to a gas-separation device 12 comprising molecular sieves. Known so-called gas-separation columns, in which gases are separated from each other by utilizing their difference in boiling points, may also be employed. In such a case, it is to be preferred to bring the gas after separation to a superatmospheric pressure by means of a compressor in order to make it possible to utilize the cryogenerator to the optimum. The cold production of the cryogenerator is in fact increased at a higher pressure of the supplied gas (comparatively high condensation temperature), while the consumed power of the cryogenerator decreases. At a higher condensation temperature, the pressure of the working medium of the cryogenerator, such as, for example, helium gas, can be increased, whereas the load of the cryogenerator remains unchanged. By the use of a superatmospheric pressure for the product gas supplied to the cryogenerator, no further pumping equipment is required. The pressure is supplied by the compressor already present in the gas-separation device comprising molecular sieves. The gas supplied to the lead 44 may alternatively originate from a storage vessel.

It should be noted that the liquid separator in the form of the liquid trap 60 has a double function. Firstly, the saturated liquid originating from the cryogenerator 54 is separated from the wet vapour originating from the cryogenerator. Further, the liquid trap 60 acts as a non return valve so that in case the reservoir 48 is arranged at a higher level than the cryogenerator 54, liquid can never flow back to the cryogenerator. In fact, instead of a liquid trap any liquid separator may be used, such as, for example, a vessel containing saturated liquid and saturated vapour in a state of thermal equilibrium, the float then being replaced by an optical sensor which controls the valve of the liquid seal. Such an optical sensor may also be used to replace the float in the level controller.

Although the invention has been described for the ranges lying between the temperatures of 288° K. and 78° K. and the pressures of 650 kP and 98 kP, it is not limited thereto. The possible operating ranges are given by the pressure-enthalpy and the temperature-entropy diagrams of the relevant gas.

What is claimed is:

1. A method of liquefying a gas, which comprises precooling such gas at a first, superatmospheric pressure in a first heat exchanger; introducing the precooled gas into a cryogenerator to effect condensation thereof; passing the resulting saturated liquid-wet vapour mixture to a liquid separator and thence to a second heat exchanger maintained in a bath of such liquid contained in a thermally isolated reservoir to effect sub-cooling of the saturated liquid and condensation of the wet vapour and sub-cooling of the resulting condensate at a second pressure, said sub-cooling and said condensation resulting in evaporation of a portion of the liquid bath in the reservoir; regulating said sub-cooling by adjusting the second pressure between a maximum corresponding to said first, superatmospheric pressure and a minimum corresponding to the pressure in the reservoir; passing the vapour resulting from said evaporation to the first heat exchanger to effect said precooling; and adding liquid from the condensate stream after the liquid separator to the liquid bath to replenish the evaporated liquid.

2. A method according to claim 1, in which liquid from the condensate stream is added to the liquid bath after the second heat exchanger.

3. A method according to claim 1, in which the pressure in the reservoir is atmospheric pressure.

4. A method according to claim 1, which includes conducting a gaseous mixture at said first, superatmospheric pressure to a molecular sieve, a first gas fraction passing through said sieve and a second gas fraction being absorbed by said sieve, said first gas fraction constituting the gas precooled in said first heat exchanger.

5. Apparatus for liquefying a gas, which comprises a thermally isolated reservoir containing a bath of liquefied gas; a thermally isolated first heat exchanger, a liquid separator, a second heat exchanger, a pressure controller, and a liquid-level controller positioned in said reservoir, said second heat exchanger being maintained in said liquefied gas bath; a cryogenerator arranged outside the reservoir; means to introduce said gas at a first, superatmospheric pressure into said first heat exchanger to precool such gas; a first lead for passing the precooled gas from the first heat exchanger to the cryogenerator to effect condensation of said gas; a second lead connecting the cryogenerator with the liquid separator and a third lead connecting the liquid separator with the second heat exchanger for passing the resulting saturated liquid-wet vapour mixture through the liquid separator and thence to the second heat exchanger to effect sub-cooling of the saturated liquid and condensation of the wet vapour and sub-cooling of the resulting condensate at a second pressure, said sub-cooling and said condensation resulting in evaporation of a portion of the liquefied gas bath; a fourth lead from the second heat exchanger to the pressure controller and thence to the exterior of the reservoir, said pressure controller regulating the sub-cooling by adjusting the second pressure between a maximum corresponding to said first, superatmospheric pressure and a minimum corresponding to the pressure in the reservoir; means for passing the vapour resulting from said evaporation to the first heat exchanger to effect the precooling and thence to the exterior of the reservoir; and a fifth lead connecting the liquid-level controller with the third lead-fourth lead system to permit supplying liquid to the liquefied gas bath to replenish the evaporated liquid.

6. Apparatus according to claim 5, in which the fifth lead connects the liquid-level controller with the fourth lead after the second heat exchanger.

* * * * *